United States Patent [19]

Watson, Jr.

[11] Patent Number: 4,680,882

[45] Date of Patent: Jul. 21, 1987

[54] IDENTIFICATION TAG

[76] Inventor: Jesse E. Watson, Jr., 710 N. Main, Homer, La. 71040

[21] Appl. No.: 812,768

[22] Filed: Dec. 23, 1985

[51] Int. Cl.[4] ..... G09F 3/20

[52] U.S. Cl. ..... 40/5; 40/20 R

[58] Field of Search ..... 40/5, 6, 20 A, 21 R, 40/491, 20 R; 283/98

[56] References Cited

U.S. PATENT DOCUMENTS 122,994 1/1872 Cottle ..... 40/6

3,384,984 5/1968 Field ..... 40/21 R

FOREIGN PATENT DOCUMENTS 1527263 10/1978 United Kingdom ..... 40/6

*Primary Examiner*—Robert Peshock

*Assistant Examiner*—Cary E. Stone

*Attorney, Agent, or Firm*—John M. Harrison

[57] ABSTRACT

An identification tag for articles and containers, which is characterized by a base tag member having an extended leg for attachment to an article or looping through the handle of a container, the base tag member further provided with spaced indicia areas for identifying the article or the contents of the container and staggered snap openings extending through opposite faces of the base tag member for receiving at least a top cap member and preferably, a top cap member and a bottom cap member, each cap member having multiple snaps for engaging the snap openings and provided with a window which is aligned with selected ones of the indicia areas when the cap members are snapped on opposite faces of the base tag member.

22 Claims, 8 Drawing Figures

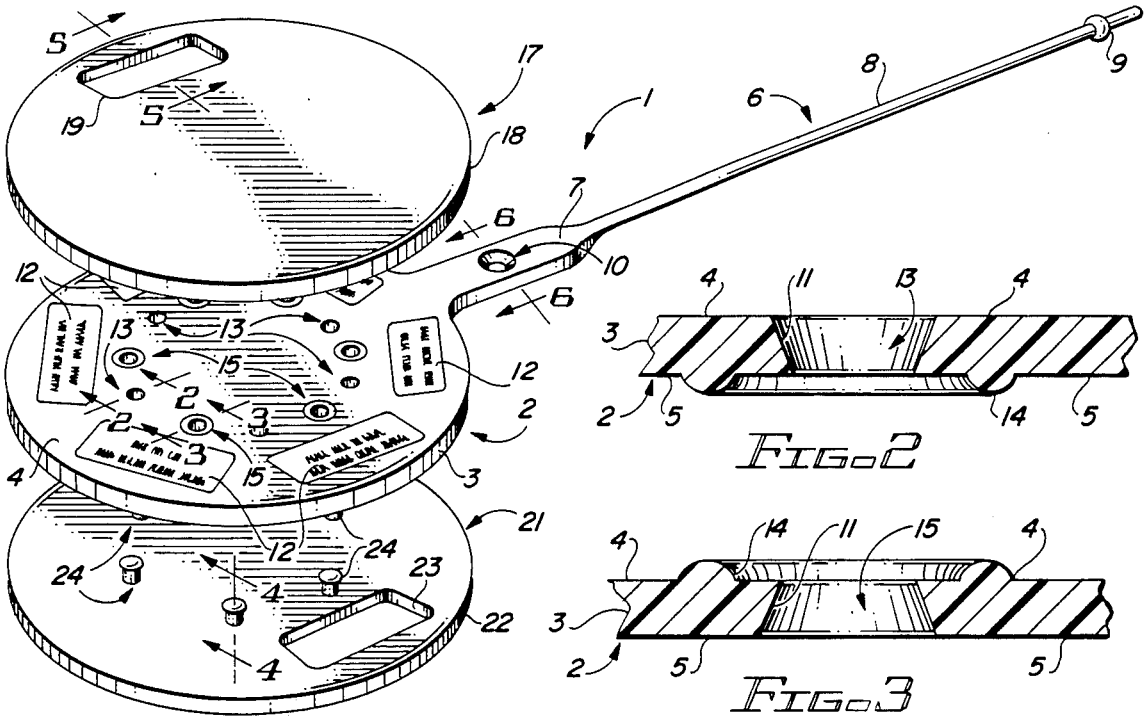
FIG. 1
FIG. 2
FIG. 3
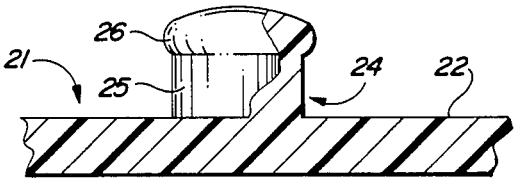
FIG. 4
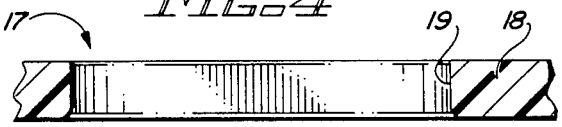
FIG. 5
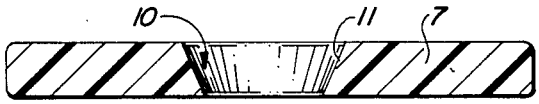
FIG. 6
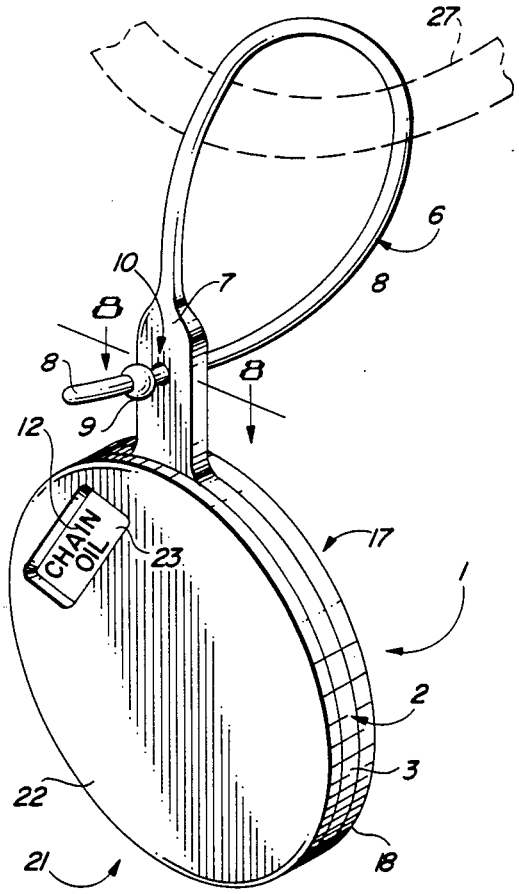
FIG. 7
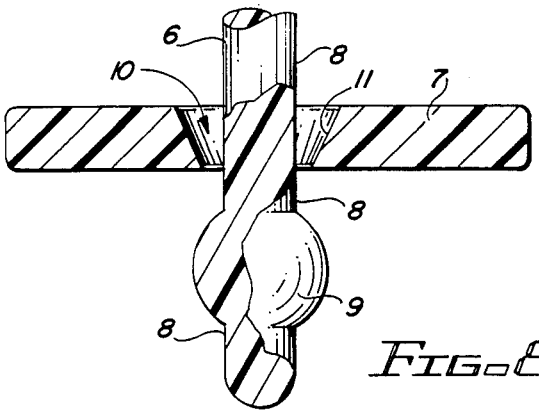
FIG. 8

IDENTIFICATION TAG

BACKGROUND OF THE INVENTION

1. Field of the Invention

This invention relates to tags and identification means and more particularly, to an identification tag for identifying an article or the contents of a container having a carrying handle such as a gasoline or solvent container or other container for storing liquids, as well as powdered or pelletized materials. The identification tag of this invention is characterized by a base tag member having an elongated leg which is designed for attachment to the article or to loop through the container handle and attach the identification tag to the handle. The base tag member further includes spaced indicia areas on at least one, and preferably both faces thereof and staggered snap openings provided therein for receiving corresponding snaps extending from cooperating top and bottom caps, each of the caps provided with windows in order to view selected ones of the indicia areas and identify the article or the contents of the container when the top and bottom caps are snapped to opposite faces of the base tag member. In a preferred embodiment the snap openings are staggered in a circular orientation and are alternately beveled and provided with a circular lip in order to facilitate a more secure engagement of the respective snaps with the snap openings in the base tag member for joining the top and bottom cap members to the base tag member. Alternatively, a single cap member can be snapped to the base tag member for identification of the article or container contents.

2. Description of the Prior Art

One of the problems associated with the identification of goods, and liquids which are stored in plastic or metal containers in particular, is that of finding an appropriate place to attach a tag or label to delineate the goods. This is particularly difficult under circumstances where the item to be identified is a container which contains a solvent such as gasoline, alcohol or other chemical and the contained liquid periodically spills or drips on the top and down the side of the container when poured from the container. Efforts to identify such containers include placing tape on the top or side of the container and writing the contents of the container directly on the container side or top with an indelible pencil or pen. However, depending upon the character of the container contents, the writing is frequently rendered illegible by contact with the contained liquid due to spillage, and mistake as to the contents of the container is the frequent result.

The identification of dry goods and articles such as baggage has been achieved in various ways in the prior art. U.S. Pat. No. 661,691, dated Nov. 13, 1900, to A. M. Goodwin, discloses a "Baggage Check Carrier" for identifying baggage. The Goodwin "Baggage Check Carrier" is characterized by a rectangular-shaped tag provided with side flanges for receiving an identifying label or decal and a strap member for attaching the tag to the handle of baggage. U.S. Pat. No. 2,655,747, dated Oct. 20, 1953, to M. L. Duskin, discloses a "Luggage Tag Strap". The "Luggage Tag Strap" is characterized by an eliptically-shaped tag member having a transparent window built therein and adapted to receive an identifying card, upon which is imprinted the owner's name and address. A strap is attached to the tag member and is fitted with a snap used to connect the strap to the handle of the luggage.

It is an object of this invention to provide an identification tag for dry goods, articles and containers of all description, which identification tag includes a base tag member having an extending leg for attachment to the container, dry goods or article and provided with spaced indicia areas on at least one face thereof. Snap openings are also provided in spaced relationship in the base tag member for receiving the snaps of at least one cap member having a window which registers with a selected one of the indicia areas on the base tag member, the snaps serving to removably secure the cap member to the base tag member.

Another object of this invention is to provide a new and improved identification tag for containers having handles, which tag is characterized by a base tag member having an elongated leg for attachment to the handle of the container and provided with spaced indicia areas on at least one face thereof and snap openings for receiving a top and bottom cap member, each having windows in alignment with the indicia areas for identifying the contents of the container.

Another object of this invention is to provide an identification tag for attachment to baggage and other goods and articles as well as solvent and other chemical containers having handles, which identification tag is characterized by a round base member having an elongated leg for attachment to the baggage, goods, articles or container handle and further provided with spaced indicia areas on at least one face and snap openings for receiving the snaps of at least one, and most preferably, a pair of top and bottom cap members having windows provided therein, with the cap members snapped to the base tag member such that at least one corresponding indicia area which identifies the baggage, goods, articles or contents of the container is viewed through the window or windows.

Another object of this invention is to provide a new and improved identification tag for material containers having handles, which identification tag includes a round base member having a leg projecting from one edge thereof and adapted to slip through the handle of the container and reattach to the base member, the base member further including spaced indicia areas on both faces thereof, at least one of which indicia areas is labeled or marked to identify the contents of the container. Alternating snap openings are also provided in the base member for receiving snaps projecting from companion top and bottom cap members having windows which register with the marked indicia area or areas to indicate the contents of the container.

SUMMARY OF THE INVENTION

These and other objects of the invention are provided in a new and improved identification tag for various articles and goods, including, in particular, containers having handles or alternative means for attachment of the tag to the containers, wherein the identification tag is characterized by a base tag member provided with an elongated leg member for attachment to the articles or goods or engaging the container handle and securing the base tag member to the handle. The base tag member further includes spaced indicia areas on at least one face thereof, at least one of which indicia areas is marked to identify the contents of the container, the base tag member also provided with alternating snap openings for receiving the snaps of at least a top cap member, and preferably both a top and a bottom cap member, each having windows, at least one of which windows registers with the marked indicia area or areas for identifying the contents of the container.

BRIEF DESCRIPTION OF THE DRAWING

The invention will be better understood by reference to the accompanying drawing, wherein:

FIG. 1 is an exploded view of a preferred embodiment of the identification tag of this invention;

FIG. 2 is a sectional view, taken along line 2—2, of a first snap opening provided in the base tag member illustrated in FIG. 1;

FIG. 3 is a sectional view, taken along line 3—3, of a second snap opening provided in the base tag member illustrated in FIG. 1;

FIG. 4 is a sectional view, taken along line 4—4, of a snap projecting from the bottom cap member illustrated in FIG. 1;

FIG. 5 is a sectional view, taken along line 5—5, of a top cap window provided in the top cap of the identification tag illustrated in FIG. 1;

FIG. 6 is a sectioanl view, taken along line 6—6, of a keeper opening provided in the tag leg of the base tag member illustrated in FIG. 1;

FIG. 7 is a perspective view of the identification tag illustrated in FIG. 1 in fully assembled and functional configuration attached to the handle of an object or container; and FIG. 8 is a sectioanl view, taken along line 8—8, of the leg keeper extending through the keeper opening in the leg base of the base tag member illustrated in FIG. 7.

DESCRIPTION OF THE PREFERRED EMBODIMENT

Referring now to FIGS. 1—3 of the drawing, the identification tag of this invention is illustrated by reference numeral 1. The identification tag 1 is characterized by a flat base tag member 2, having a round tag body 3 with a flat top base 4 and bottom face 5, as is more particularly illustrated in FIGS. 2 and 3. An elongated tag leg 6 projects from the edge of the tag body 3 and is further characterized by an enlarged leg base 7 having a keeper opening 10 extending transversely therethrough, with a more narrow, round, flexible leg extender 8 projecting from the tag base 7. A leg keeper 9 is provided on the leg extender 8 near the extending end of the leg extender 8 and serves to retain the extending end of the leg extender 8 in the keeper opening 10 when the identification tag 1 is attached to the handle of a container, as hereinafter described. As further illustrated in FIG. 1, multiple rectangular-shaped indicia areas 12 are provided in spaced relationship in the top face 4 of the tag body 3 and are designed to receive the names of various materials which may be placed in a container, for identification purposes. Multiple top snap openings 13 and bottom snap openings 15 are provided in alternating, circular relationship in the top face 4 and extend through the tag body 3 and the bottom face 5 to secure a top cap member 17 and a bottom cap member 21 to the top face 4 and bottom face 5, respectively, as hereinafter described. In a preferred embodiment of the invention the top snap openings 13 are characterized as illustrated in FIG. 2, with a taper 11 extending from a wide opening at the top face 4, to a more narrow opening at the bottom face 5. In contrast, the bottom snap openings 15, which are provided in alternating relationship and in curved alignment with respect to the top snap openings 13, are illustrated in FIG. 3 and taper from a narrow opening at the top face 4 to a wider opening at the bottom face 5 of the tag body 3. Furthermore, referring again to FIGS. 2 and 3 of the drawing, in a most preferred embodiment of the invention a lip 14 is provided in the bottom face 5, as illustrated in FIG. 2, surroundng each of the top snap openings 13 and in the top face 4, as shown in FIG. 3, surrounding each of the bottom snap openings 15. Each lip 14 serves to strengthen those areas of the tag body 3 which surround each of the top snap openings 13 and bottom snap openings 15.

Referring now to FIGS. 1 and 4 of the drawings, both the top cap member 17 and the bottom cap member 21 are provided with snaps 24, which are illustrated projecting from the bottom cap body 22 of the bottom cap member 21. However, it is understood that identical snaps 24 project from the top cap body 18 of the top cap member 17, as hereinafter described. Those snaps 24 which extend from the top cap body 18 are spaced in a circular orientation in the top cap body 18 for registration with the top snap openings 13, extending through the tag body 3 of the base tag member 2. A top cap window 19 is provided in the top cap body 18 and the top cap window 19 is oriented in the top cap body 18 so as to be substantially coextensive with a selected one of each of the indicia areas 12 provided in the top face 4 of the tag body 3 when the snaps 24 extending from the top cap body 18 register with the companion top snap openings 13. Similarly, the upward-standing snaps 24, projecting from the bottom cap body 22, are spaced in a circular orientation which is staggered with respect to the snaps 24 extending from the top cap body 18, so as to register with the bottom snap openings 15 provided in the tag body 3 of the base tag member 2. The bottom cap body 22 of the bottom cap member 21 is provided with a bottom cap window 23, which is designed to correspond with a selected one of additional indicia areas 12 located on the bottom face 5 of the tag body 3 (not illustrated) when the snaps 24 carried by the bottom cap body 22 register with the bottom snap openings 15. As illustrated in FIG. 4 of the drawing, in another most preferred embodiment the snaps 24 are each shaped to define a cylindrical post 25, extending from the bottom cap body 22 and capped by a rounded head 26, which head 26 facilitates easy entry into the tapered bottom snap openings 15, but enables removal of the snaps 24 from the respective bottom snap openings 15 only by the exertion of substantial pressure. Accordingly, when the respective snaps 24 are inserted in the corresponding top snap openings 13 and bottom snap openings 15, the top cap member 17 and bottom cap member 21 are thusly prevented from inadvertent removal from the base tag member 2. Furthermore, referring again to FIGS. 2 and 3 of the drawing and as heretofore indicated, each lip 14 serves to prevent those areas of the tag body 3 which surround the top snap openings 13 and bottom snap openings 15 from tearing or splitting when each head 26 of the snaps 24 is forced through the respective taper 11 of the top snap openings 13 and bottom snap openings 15.

Referring now to FIGS. 7 and 8 of the drawing it will be appreciated that when the snaps 24 which project from the top cap body 18 of the top cap member 17 are inserted in the top snap openings 13 and the bottom snaps 24 which extend from the bottom cap body 22 of the bottom cap member 21 are inserted in the bottom snap openings 15 in the tag body 3, the identification tag 1 is constituted as illustrated in FIG. 7 as a laminate which includes the base tag member 2, sandwiched between the top cap member 17 and the bottom cap member 21. The identification tag 1 is then secured to a container handle 27 (illustrated in phantom in FIG. 7) by looping the flexible leg extender 8 around the container handle 27 and projecting the extending end of the leg extender 8 and the leg keeper 9 through the keeper opening 10, to secure the identification tag 1 to the container handle 27. As further illustrated in FIGS. 6 and 8 of the drawing, the keeper opening 10 is also tapered from a large opening at the point of entry of the leg keeper 9 to a smaller opening in the exit thereof, as illustrated in FIGS. 7 and 8, in order to secure the leg extender 8 to the leg base 7 until it is desired to again withdraw the leg keeper 9 back through the keeper opening 10 and remove the identification tag 1 from the container handle 27.

Referring again to the drawing, in a further preferred embodiment of the invention the indicia areas 12 located on the top face 4 and bottom face 5 of the tag body 3 are designed to facilitate convenient marking of the names or identification codes of various container contents prior to application of the top cap member 17 and bottom cap member 21 to the base tag member 2. For example, a first indicia area 12 can be marked a a "regular gas", while a second indicia area 12 might be designated "regular gas, 50:1 oil." The third indicia area 12 can be marked as "regular gas, 25:1 oil". And so on, with other materials also noted in additional indicia areas 12; for example, as "no-lead gas", "herbicide", "insecticide", "fertilizer", "charcoal lighter" and the like. It will further be appreciated that when the top cap member 17 and bottom cap member 21 are then snapped onto the base tag member 2 as heretofore described, they are positioned such that the indicia area 12 which identifies the desired contained liquid or material can be viewed through either the top cap window 19 or the bottom cap window 23, or both. In a preferred configuration for the identification tag 1, either the top cap window 19 or the bottom cap window 23 is aligned in registration with the particular indicia area 12 which identifies the liquid or material located in the container, while the other window is aligned with a blank space provided in another one of the indicia areas 12 located on the opposite face of the tag body 3, in order to avoid confusion as to the contents of the container.

Referring again to FIGS. 1 and 7 of the drawing, in yet another preferred embodiment of the invention either the top cap member 17 or the bottom cap member 21 is secured to the tag body 3 of the base tag member 2 according to the procedure outlined above. Accordingly, the identification tag 1 is characterized by a laminate of only a single cap member and the base tag member 2, when the identification tag 1 is assembled as illustrated in FIG. 7. Under these circumstances only a single set of either the top snap openings 13, if the top cap member 17 is used, or the bottom snap openings 15, if the bottom cap member 21 is used, need be provided in the tag body 3 of the base tag member 2. However, even under circumstances where either the top cap member 17 or the bottom cap member 21 is used in cooperation with the base tag member 2, in a most preferred embodiment both the top snap openings 13 and bottom snap openings 15 are provided in the tag body 3, in order to accommodate either or both, the top cap member 17 and/or the bottom cap member 21, as desired.

It will be further appreciated by those skilled in the art that while the identification tag 1 can be fabricated of a variety of materials, in a most preferred embodiment of the invention the base tag member 2, top cap member 17 and bottom cap member 21 are fashioned from well known plastic materials such as polyethylene and polypropylene by injection molding techniques which are well known to those skilled in the art. In this manner, multiple components of the identification tag 1 can be manufactured using a single mold for each component, with a high degree of accuracy. Under these circumstances the indicia areas 12 are most preferably shaped in the top face 4 and bottom face 5 in a matt finish which facilitates easy marking with an indelible pen.

It will also be further appreciated by those skilled in the art that the identification tag of this invention can be utilized in applications other than for the identification of liquids or powdered or pelletized materials stored in or dispensed from various types of containers. For example, as heretofore indicated, the identification tag 1 can be equally well clipped or stapled to selected goods and otherwise applied to articles and goods such as luggage and baggage of any and all description, particularly under circumstances where all family members have provided their names in the indicia areas 12 and the family member using the baggage for a specific trip can adjust the top cap member 17 or the bottom cap member 21 or both of them, to view his name through either the top cap window 19 or the bottom cap window 23 or both, as desired. The identification tag 1 can also be used to identify such items as furniture and other items of equipment which are placed on sale or display, with the indicia areas 12 indicating various sale prices or noting the particular characteristics of the furniture or merchandise displayed. Furthermore, while the identification tag 1 can be shaped in any desired configuration, a round shape is preferred in order to align the top cap window and bottom cap member or either of them, with the spaced indicia areas 12, when the top cap member 17 and bottom cap member 21 are snapped onto the base tag member 2, as heretofore described.

Other applications for the identification tag of this invention will become apparent to those skilled in the art and while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. An identification tag for attachment to an article, comprising substantially flat base tag means; attachment means extending from said base tag means for securing said base tag means to the article; a first plurality of apertures provided in a first selected orientation in said base tag means and a second plurality of apertures provided in a second selected orientation in said base tag means; at least one indicia space provided on said base tags means; and a first cap located on one side of said base tag means and provided with a first plurality of snaps oriented in registration with said first plurality of apertures and a second cap located on the opposite side of said base tag means and provided with a second plurality of snaps oriented in registration with said second plurality of apertures, and a window in said cap means, whereby when said snaps are provided in registration with said apertures for securing said first cap and said second cap to said base tag means, said window substantially corresponds to said indicia space.

2. The identification tag of claim 1 wherein said first selected orientation of said first plurality of apertures and said second selected orientation of said second plurality of apertures are arranged in a staggered aperture pattern in said base tag means and said first plurality of snaps and said second plurality of snaps are carried by said first cap and said second cap in a staggered snap pattern, respectively, said staggered snap pattern substantially corresponding to said staggered aperture pattern.

3. The identification tag of claim 2 wherein said staggered aperture pattern and said staggered snap pattern are round.

4. The identification tag of claim 1 wherein said attachment means is further characterized by a leg base extending from said base tag means; a keeper opening provided in said leg base; an elongated leg extender projecting from said leg base and a leg keeper provided on the extending end of said leg extender, whereby said leg extender engages the article and said leg keeper registers with said keeper opening.

5. The identification tag of claim 1 wherein:

(a) said first selected orientation of said first plurality of apertures and said second selected orientation of said second plurality of apertures are arranged in a staggered aperture pattern in said base tag means and said first plurality of snaps and said second plurality of snaps are carried by said first cap and said second cap in a staggered snap pattern, respectively, said staggered snap pattern corresponding to said staggered aperture pattern; and (b) said attachment means is further characterized by a leg base extending from said base tag means; a keeper opening provided in said leg base; an elongated leg extender projecting from said leg base and a leg keeper provided on the extending end of said leg extender, whereby said leg extender engages the article and said leg keeper registers with said keeper opening.

6. The identification tag of claim 5 wherein said staggered aperture pattern and said staggered snap pattern are round.

7. The identification tag of claim 6 wherein said first plurality of snaps and said second plurality of snaps are each characterized by an enlarged head portion terminating said snaps for securely engaging said first plurality of apertures and said second plurality of apertures, respectively.

8. The identification tag of claim 1 wherein said first plurality of snaps and said second plurality of snaps are each characterized by an enlarged head portion terminating said snaps for securely engaging said first plurality of apertures and said second plurality of apertures, respectively.

9. The identification tag of claim 1 wherein said first plurality of apertures are each provided with a first taper, said second plurality of apertures are each provided with a second taper, with said second taper reversed with respect to said first taper and said first plurality of snaps and said second plurality of snaps are each provided with a post and an enlarged head terminating said post, whereby when said head and said post are extended through said first plurality of apertures and said second plurality of apertures, respectively, said first taper and said second taper prevent said head from inadvertently exiting said first plurality of apertures and said second plurality of apertures, respectively.

10. The identification tag of claim 1 further comprising a lip encircling each of said first plurality of apertures and said second plurality of apertures, respectively.

11. The identification tag of claim 1 further comprising a lip encircling each of said first plurality of apertures and said second plurality of apertures, respectively, and wherein said first plurality of apertures are each provided with a first taper, said second plurality of apertures are each provided with a second taper, with said second taper reversed with respect to said first taper and said first plurality of snaps and said second plurality of snaps are each provided with a post and an enlarged head terminating said post, whereby when said head and said post are extended through said first plurality of apertures and said second plurality of apertures, respectively, said first taper and said second taper prevent said head from inadvertently exiting said first plurality of apertures and said second plurality of apertures, respectively.

12. The identification tag of claim 11 wherein said first selected orientation of said first plurality of apertures and said second selected orientation of said second plurality of apertures are arranged in a staggered aperture pattern in said base tag means and said first plurality of snaps and said second plurality of snaps are carried by said first cap and said second cap in a staggered snap pattern, respectively, said staggered snap pattern substantially corresponding to said staggered aperture pattern.

13. The identification tag of claim 12 wherein said staggered aperture pattern and said staggered snap pattern are round.

14. An identification tag for attachment to an article having a handle, comprising:

(a) substantially flat base tag means and a plurality of indicia spaces provided in spaced relationship on both faces of said base tag means;

(b) an elongated, substantially flexible tag leg projecting from said base tag means;

(c) a first plurality of apertures provided in a first selected orientation in said base tag means and a second plurality of apertures provided in a econd orientation in said base tag means, said first plurality of apertures and said second plurality of apertures extending substantially transversely through said base tag means in a selected pattern; and (d) a first cap located on one side of said base tag means and provided with a first plurality of snaps oriented in registration with said first plurality of apertures and a second cap located on the opposite side of said base tag means and provided with a second plurality of snaps oriented in registration with said second plurality of apertures, a window provided in said first cap and said second cap, respectively, for securing said cap means to said base tag means and viewing a selected one of said indicia spaces through said window.

15. The identification tag of claim 14 wherein said at least one cap means is a pair of caps secured to opposite sides of said base tag means and said tag leg further comprises a leg base extending from an edge of said base tag means; a keeper opening provided in said leg base; an elongated flexible leg extender projecting from said leg base and a leg keeper provided on the extending end of said leg extender, whereby said leg extender extends between the handle and the article and said leg keeper registers with said keeper opening.

16. The identification tag of claim 14 wherein said first selected orientation of said first plurality of apertures and said second selected orientation of said second plurality of apertures are arranged in a staggered aperture pattern in said base tag means and said first plurality of snaps and said second plurality of snaps are carried by said first cap and said second cap in a staggered snap pattern, respectively, said staggered snap pattern substantially corresponding to said staggered aperture pattern.

17. The identification tag of claim 16 wherein said first plurality of apertures are each provided with a first taper, said second plurality of apertures are each provided with a second taper, with said second taper reversed with respect to said first taper and said first plurality of snaps and said second plurality of snaps are each provided with a post and an enlarged head terminating said post, whereby when said head and said post are extended through said first plurality of apertures and said second plurality of apertures, rspectively, said first taper and said second taper prevent said head from inadvertently exiting said first plurality of apertures and said second plurality of apertures, respectively.

18. The identification tag of claim 17 wherein said tag leg further comprises a leg base extending from an edge of said base tag means; a keeper opening provided in said leg base; an elongated, flexible leg extender projecting from said leg base and a leg keeper provided on the extending end of said leg extender, whereby said leg extender extends between the handle of the article and said leg keeper registers with said keeper opening.

19. An identification tag for attachment to a container having a handle comprising:

(a) a subsantially flat, round base tag, a plurality of indicia spaces provided on both faces of said base tag and a leg base projecting from the edge of said base tag; an elongated, flexible leg extender projecting from said leg base; and a leg keeper provided on the extending end of said leg extender, whereby said leg extender projects between the handle and the container and said leg keeper registers with said keeper opening;

(b) a first plurality of apertures provided in a first selected orientation in said base tag and a second plurality of apertures provided in a second selected orientation in said base tag; and (c) a first cap located on one side of said base tag and provided with a first window for alignment with a first selected one of said indicia spaces and a first plurality of snaps oriented in registration with said first plurality of apertures, and a second cap located on the opposite side of said base tag and provided with a second window for alignment with a second selected one of said indicia spaces and a second plurality of snaps oriented in registration with said second plurality of apertures, whereby said first cap and said second cap are secured to opposite sides of said base tag.

20. The identification tag of claim 19 wherein said first selected orientation of said first plurality of apertures and said second selected orientation of said second plurality of apertures are arranged in a staggered aperture pattern in said base tag means and said first plurality of snaps and said second plurality of snaps are carried by said first cap and said second cap in a staggered snap pattern, respectively, said staggered snap pattern substantially corresponding to said staggered aperture pattern.

21. The identification tag of claim 20 wherein said staggered aperture pattern and said staggered snap pattern are round.

22. The identification tag of claim 21 wherein said first plurality of apertures are each provided with a first taper, said second plurality of apertures are each provided with a second taper, with said second taper reversed with respect to said first taper and said first plurality of snaps and said second plurality of snaps are each provided with a post and an enlarged head terminating said post, whereby when said head and said post are extended through said first plurality of apertures and said second plurality of apertures, respectively, said first taper and said second taper prevent said head from inadvertently exiting said first plurality of apertures and said second plurality of apertures, respectively.

* * * * *